United States Patent [19]

Raudat

[11] 4,216,855

[45] Aug. 12, 1980

Best Available Copy

[54] LINE BRAKE ASSEMBLY FOR CASE PACKER

[75] Inventor: John L. Raudat, Madison, Conn.

[73] Assignee: Standard-Knapp, Inc., Portland, Conn.

[21] Appl. No.: 955,489

[22] Filed: Oct. 27, 1978

[51] Int. Cl.[2] ..... B65G 47/26; B65G 47/88

[52] U.S. Cl. ..... 198/633; 198/425; 198/836

[58] Field of Search ..... 53/496, 497, 543, 495, 53/247, 248, 539; 198/459, 425, 491, 502, 468, 856, 486, 634, 633, 836; 294/87 R

[56] References Cited

U.S. PATENT DOCUMENTS

| | | | |
|---|---|---|---|
| 2,969,629 | 1/1961 | Blais | 53/495 X |
| 3,052,071 | 9/1962 | Copping | 198/425 X |
| 3,433,966 | 3/1969 | Letch et al. | 198/502 X |
| 3,702,524 | 11/1972 | Johnson et al. | 53/497 |
| 3,965,650 | 6/1976 | Nussbaum | 53/539 |
| 3,979,878 | 9/1976 | Berney | 53/495 |

FOREIGN PATENT DOCUMENTS

| | | | |
|---|---|---|---|
| 1926995 | 5/1971 | Fed. Rep. of Germany | 53/497 |

*Primary Examiner*—James L. Rowland

*Attorney, Agent, or Firm*—McCormick, Paulding & Huber

[57] ABSTRACT

In a case packer lanes are provided for advancing articles into a grid structure where they are segregated for packing into upwardly open packing cases positioned on a lift table associated with the packer. A line brake assembly is provided to interrupt the flow of articles during the actual packing step, and the line brake disclosed is conveniently adjustable in height to accommodate articles of different size. Individual brake subassemblies clamp the endmost articles in several side-by-side lanes, and all of these are driven by a single air cylinder. Down bottle detectors determine when an article falls down, and these detectors are mounted in the same vertically adjustable line brake assembly. The lane defining structure is adjustable to accommodate articles of different diameter, and the detectors themselves are also movably mounted for convenient adjustment to accommodate articles of different diameter.

10 Claims, 6 Drawing Figures

LINE BRAKE ASSEMBLY FOR CASE PACKER

This invention relates generally to case packers of the type wherein side-by-side lines of articles are fed between lane defining structure, across a fixed deadplate, and into a grid to form one or more groups of articles to be packed in an upwardly open packing case. More particularly, the articles are continuously urged across the deadplate by line pressure to an infeed conveyor system operating continuously, and thereby requiring a line brake assembly to clamp at least the endmost article in each lane during the packing phase.

In accordance with the present invention an improved assembly is provided which permits the several side-by-side articles to be braked simultaneously by a single pneumatic cylinder, and which assembly also permits the detection of bottles or articles upstream of the brake assembly which might have been knocked down so as to shut down the automated packer before a jam up occurs. The entire assembly is vertically adjustable to accommodate articles of different height by reference to a sample placed at a particular location below a gauge block in the assembly, and the lane defining structure, together with the down bottle detectors, are readily adjustable laterally to accommodate articles of different width or diameter.

The assembly comprises a fixed frame with upright portions which define vertically extending slots, and a horizontally extending cross beam is mounted on clamping bolts at either end to the upright frame portions. A single fluid motor has its fixed part secured to the cross beam and its movable part is adapted to reciprocate a bracket structure in which several side-by-side brake pads are resiliently provided at selected lateral locations. An article height gage block is secured to the cross beam above a fixed reference pad on the frame of the machine, and a crank is provided for raising and lowering the cross beam in order to properly locate the brake pads and down bottle detectors vertically for the handling of articles of predetermined height. The detectors are pivotally mounted on a cross shaft which includes a flat segment such that these detectors can be manually moved to a predetermined position for convenience in sliding them axially along the shaft when the machine is to be setup for handling articles of different diameter.

One important object of the present invention is to provide in a single assembly both a down bottle detector system and also a line brake system so that both of these systems are quickly adjustable by a single hand crank to accommodate articles of various height. In using this line brake assembly, a sample article is placed on a fixed portion of the machine below a conveniently mounted gage such that the hand crank can be used to adjust the gage downwardly till it meets the top of the bottle thus setting both the brake assembly and the detectors at the correct height above the infeed conveyor and associated deadplate across which these articles are fed into the grid of the case packer.

Another object of the present invention is to provide an improved means for adjusting the location of the down bottle detectors laterally in order to provide a quick changeover in the machine for accommodating articles or bottles of various diameter. The lane defining structure is provided with threaded shafts upon which the lane separators are mounted, and U-shaped collars are provided on these shafts to permit the lane defining structure to be quickly adjusted. The detectors pivot downwardly during operation, and these are provided on a cross shaft which has a flat section or segment such that the down bottle detectors can be moved manually to an upwardly extending position so as to be conveniently shifted laterally in conjunction with the lane defining structure itself. Each down bottle detector has a projecting pin provided in the opening which receives a threaded shaft such that the pin engages the valley between adjacent threads of the shaft to permit pivotal movement thereof but to restrict the detector against axial movement once it has been so located.

FIGS. 2 and 3 show the various brake subassemblies carried by the vertically adjustable line brake structure in the apparatus of FIG. 1.

Figure 1:
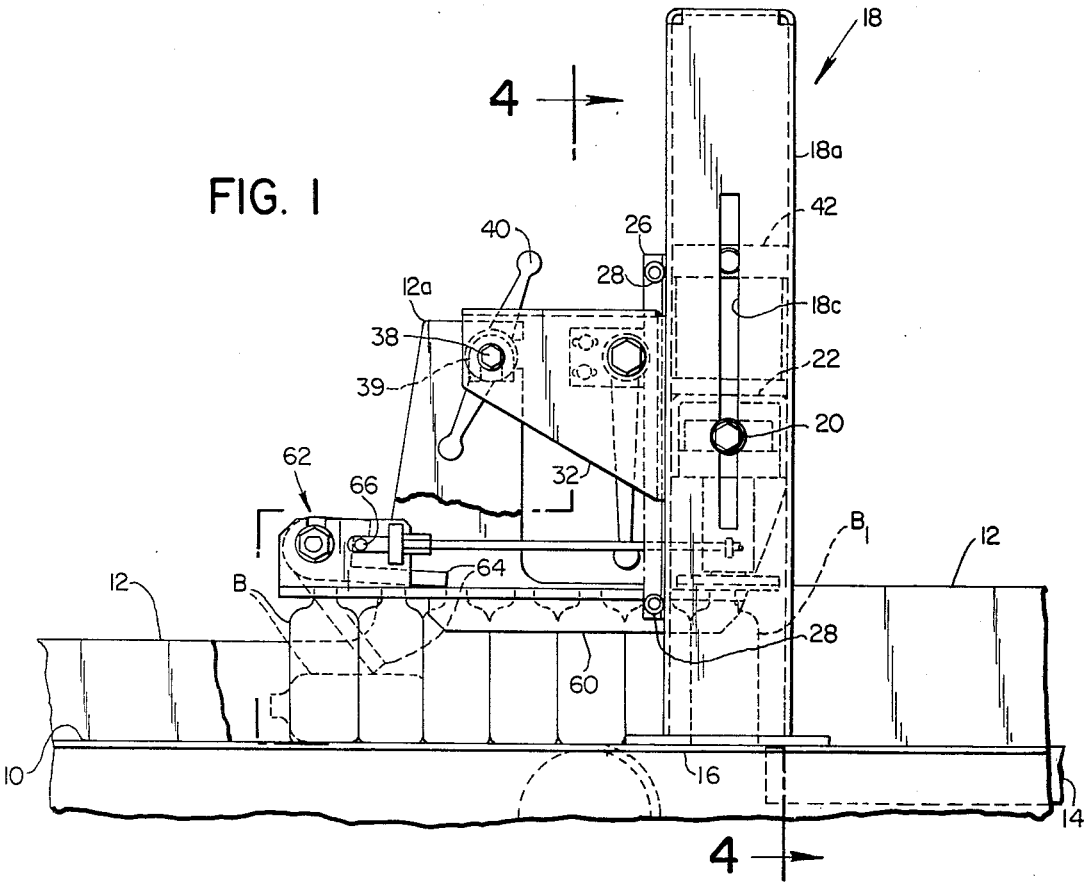
FIG. 1 is a side elevational view of a line brake assembly incorporating the present invention with portions of the case packer being eliminated to better illustrate the invention. The down bottle detector is shown in its normal position, the latter in broken lines.

Turning now to the drawings in greater detail, FIG. 1 shows a continuously driven infeed conveyor 10 upon which articles in the form of containers or bottles are provided in side-by-side relationship so as to be fed continuously in the downstream direction indicated generally by the arrow associated with the conveyor 10. In accordance with conventional practice lane defining structure 12 is provided above the conveyor 10 and suitable means (not shown) is provided for feeding the articles into several side-by-side lines such that the articles are continuously fed in the direction of the arrow. The conveyor 10 is preferably constructed of interconnected steel plates or the like so that the flow of articles can be interrupted by a braking device without interrupting the movement of the conveyor 10. Such a conveyor is typically used with a grid type drop packer wherein slugs or groups of articles are formed in appropriate numbers of rows and columns so as to be conveniently dropped into an upwardly open packing case (not shown). The grid structure for accommodating the articles in such a case packer generally takes the form of the lane defining structure 12 and a shifting grid such that the segregated group of articles can be moved slightly in the downstream direction, after the flow of articles has been interrupted by a suitable braking device, and a typical case packer also includes means for shifting the support for these bottles such that they can be dropped downwardly through a funnel or the like into the upwardly open packing case (not shown).

Figure 4:
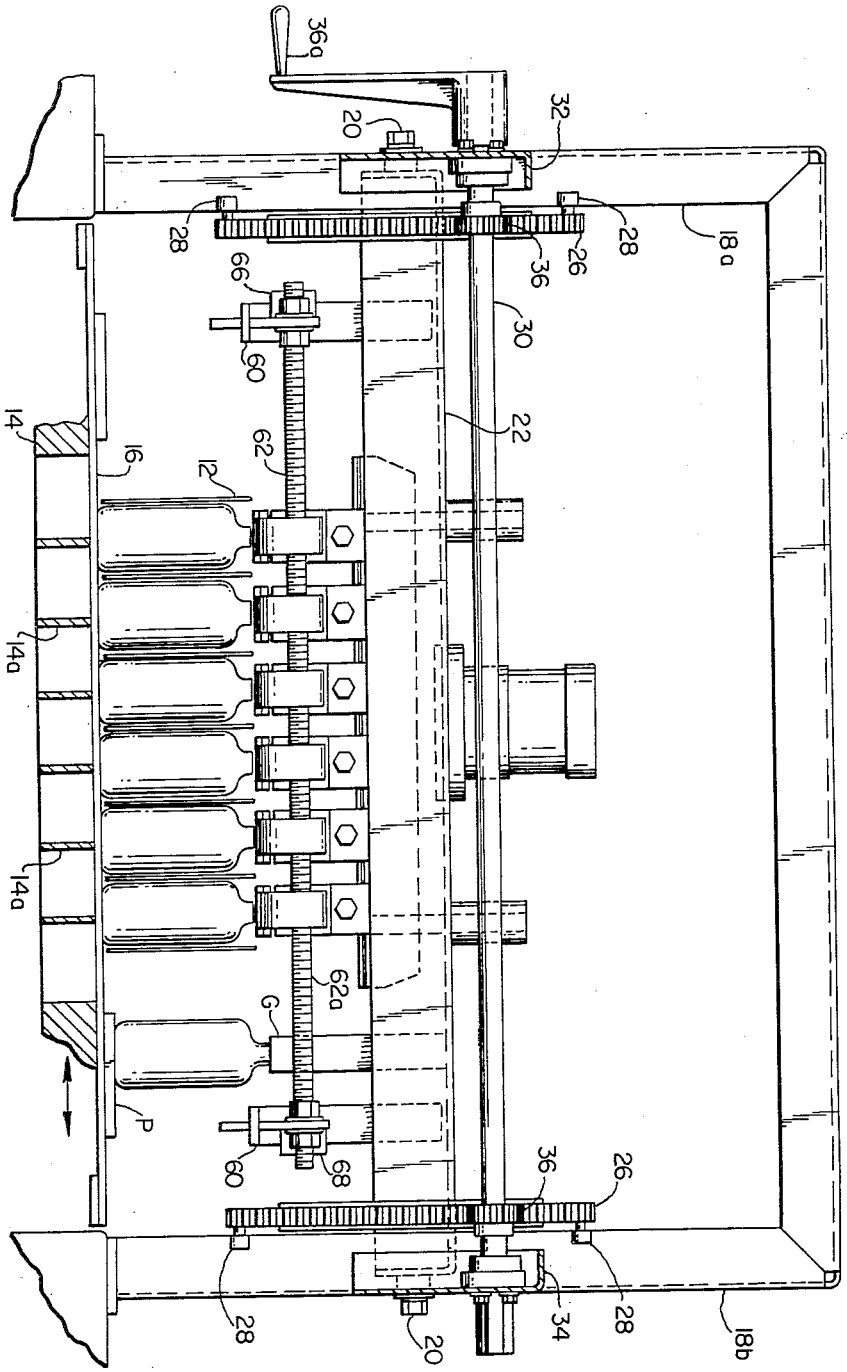
FIG. 4 is a view taken generally on the line 4—4 of FIG. 1, that is looking downstream into the apparatus of FIG. 1 and also illustrating in pertinent part a portion of the shifting grid assembly to which the articles are dropped into the packing case (not shown) which is positioned below the grid in a typical case packer.

FIG. 4 shows such a shifting grid structure at 14, and it will be apparent that the support rails 14*a*, 14*a* for the bottles located in the grid can be shifted laterally to align these supports with the lane defining structure 12 with the result that the bottles B,B drop downwardly into the packing case (not shown).

With the foregoing explanation the environment for the present invention will be more readily appreciated. In the preferred embodiment of FIG. 1 a deadplate 16 is provided between the downstream end of the conveyor 10 and the shifting grid 14 such that the endmost article B1 in the line of articles shown can be braked between the deadplate, and a brake subassembly to be described in order to provide clearance between the grid 14 and the endmost article B1 in each line of articles being handled. The grid 14 also shifts slightly in the downstream direction but the mechanism for accomplishing such movement of the grid 14 forms no part of the present invention.

A fixed U-shaped frame best shown in FIG. 4 and indicated generally at 18 is provided above the path of movement of the articles as they pass downstream into the grid 14, and said fixed frame includes vertically extending upright portions 18*a* and 18*b* which are anchored at the lower end to the fixed frame of the machine as shown. Each upright portion 18*a* and 18*b* includes a vertically extending slot or guide means 18*c* in which slot a bolt 20 is slidably received as best shown in FIG. 1. With reference to FIG. 4 these bolts 20, 20 are mounted in the opposite ends of a horizontally extending cross beam 22 which cross beam is vertically adjustable by loosening these bolts 20, 20 and by clamping the bolts in any desired relationship with respect to the fixed frame 18, accordingly as the vertical height of the articles to be handled dictates.

More particularly, the cross beam 22 is of generally inverted U-shape and one leg of the U-shape cross beam 22 supports a pair of vertically oriented racks 26, 26. The upper and lower ends of each of these racks 26, 26 carry rollers 28 which rollers engage the flanges of the U-shaped upright portion 18*a* and 18*b*. A shaft 30 is journalled in projecting bracket portions 32 and 34 of the uprights 18*a* and 18*b*, and this shaft 30 carries pinion gears 36, 36 adjacent its end portions, which pinions mesh with the rack gear segments 26, 26 so that a crank 36*a* provided on one or the other end of the shaft 30 can be utilized to raise and lower the cross beam 22. A gage block G is secured to the cross beam 22 above a fixed reference pad P as shown in FIG. 4.

Still with reference to the projecting bracket portions 32 and 34 provided on the fixed frame of the apparatus a threaded cross shaft 38 is provided adjacent the outer end of these brackets in order to provide support for the various lane defining elements in the structure 12. In accordance with conventional practice a pair of hand operated nuts 40 are provided on opposite sides of the lane defining structure, together with U-shaped spacer elements 39, 39 of appropriate width which are located between the lane defining elements in order to locate these lane defining elements for accommodating bottles B, B of the desired diameter. The various lane defining elements within the lane defining structure 12 are supported in various locations along a packer of the type described herein, and each lane defining element has a portion 12*a* projecting upwardly above the path of movement of articles being handled therebetween such that these lane defining elements can be supported in this manner, as suggested in FIG. 1. The lane defining structure is fixed once it has been adjusted to accommodate articles of a particular diameter and extends downstream, across, and above the shifting grid structure 14, without interfering with the operation of the packer itself, as suggested in FIG. 1. Further, the shifting grid structure may be operated by detectors located at the downstream ends of the lane defining structure in accordance with conventional practice.

Figure 2:
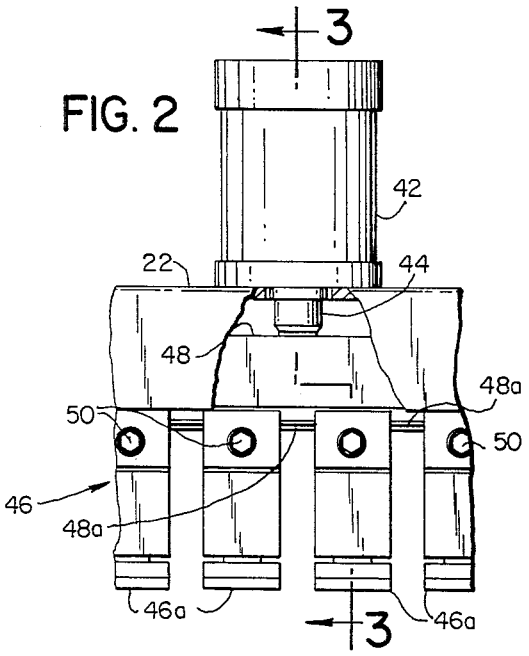
FIG. 2 is a detailed view of a portion of the apparatus shown in FIG. 1 looking in the direction of flow of the articles through the apparatus of FIG. 1.
Figure 3:
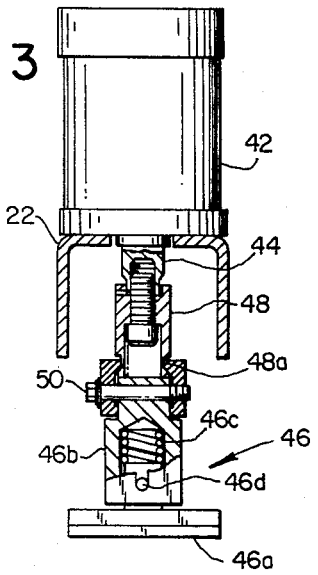
FIG. 3 is a sectional view taken generally on the line 3—3 of FIG. 2 and both

Turning next to a more complete description of the vertically adjustable cross beam assembly 22 FIGS. 2 and 3 show a fluid motor 42 having a fixed part mounted to the top of the cross beam 22, and having a movable part 44 extending through an opening provided for this purpose in the cross beam 22 and movable from the position shown in FIG. 3 to a position below the FIG. 3 position such that a bottle can be clamped between the deadplate 16 and the lower end of the brake subassembly, indicated generally at 46 in FIG. 3. The stroke of fluid motor 42 is preferably small, and as best shown in FIG. 2 several such brake assemblies 46, 46 are provided on a horizontally extending bracket means 48. The bracket means 48 is connected to the lower end of the movable fluid motor part 44 and defines a horizontally extending guideway means 48*a* such that each of these brake subassemblies 46, 46 can be located at any desired location along the bracket means 48 in order to be properly located with respect to the various lane defining elements within the lane defining structure 12 described above. Suitable screws 50 are provided in association with each of the brake subassemblies 46 in order to clamp each brake assembly 46 to a desired lateral location on the bracket means 48 and hence with respect to the cross beam 44 and lane defining structure 12.

Each brake subassembly 46 includes a brake pad 46*a* having an upwardly extending boss slidably received for limited vertical motion in a head portion 46*b* which is clamped as described above. A coil compression spring 46*c* is provided between these parts which spring biases the brake pad 46*a* downwardly toward a limit position defined by a pin and slot connection indicated at 46*d*. Thus the brake pads 46*a* accommodate articles of varing height as suggested in FIG. 4. The single fluid motor 42 is adapted to clamp a plurality of bottles B,B arranged across the deadplate 16, in spite of the slight variations in height of these articles, as a result of these spring biased brake pads.

Figure 5:
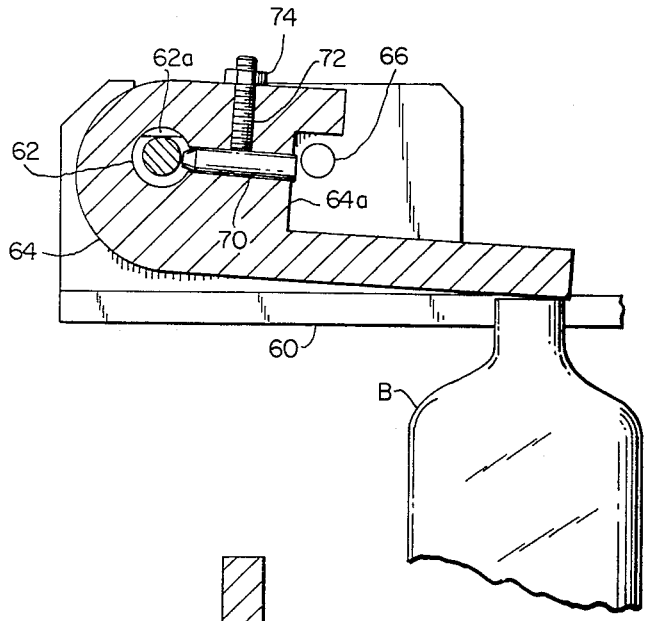
FIG. 5 is an enlarged view of a portion of a down bottle detector such as illustrated in FIG. 1, being shown at least in part in vertical section to reveal the details of this part.

Still with reference to the vertically adjustable brake assembly structure provided within the fixed frame 18, cross beam 22 is provided with projecting brackets 60, 60 extending generally horizontally in the upstream direction as best shown in FIGS. 1 and 4 which brackets 60, 60 provide support for a down bottle detector system to be described. Adjacent the cantilevered end portion of each bracket 60, 60 support means is provided for end portions of a cross shaft 62, which cross shaft is threaded as shown in FIG. 4, the purpose of the thread being to provide a pivotal connection for each of the down bottle detectors 64, 64, of which six are shown in FIG. 4. Still with reference to FIG. 4 one of these brackets 60 includes a source of light 66 which light is focused to provide a beam generally parallel to the axis of the down bottle detector support screw 62, and into a photocell 68 provided for this purpose in the opposite bracket 60 at the other side of the apparatus. This light beam is intended to pass through the openings 64*a* as suggested by the FIG. 5 view, wherein detector 64 is depicted as having a generally U-shaped configuration with one leg significantly longer than the other, but with these legs cooperating to define the opening 64*a* therebetween. When the detector 64 is in the position shown in FIG. 5, that is with the longer leg engaging the upper end of a bottle B light will pass from the source 66 to the photocell 68 as suggested in this view. When a bottle is knocked down on the conveyor, detector 64 will pivot from the position shown in FIG. 5 to the broken line position shown in FIG. 1 with the result that the shorter of the two legs on the detector 64 will block the path for the light beam indicating that the packer should be interrupted in its operation.

Figure 6:
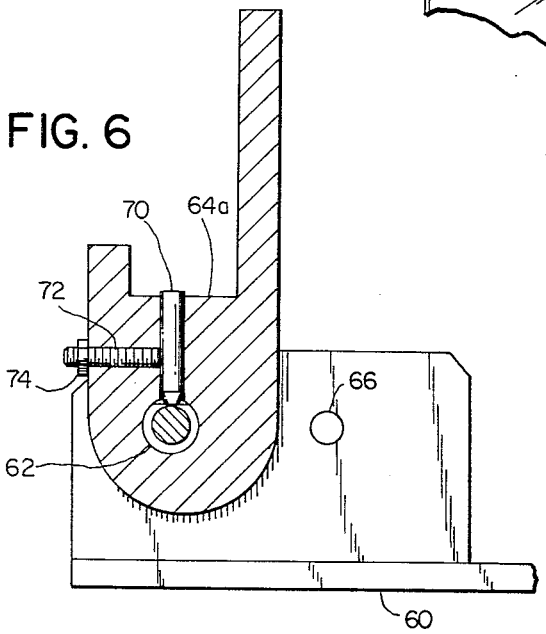
FIG. 6 is a view similar to FIG. 5 but showing the detector raised upwardly to a position suitable for adjusting the axial position of the detector along its associated support shaft.

As mentioned previously each detector is pivotally mounted on the shaft 62 and it is a feature of the present invention that each detector is restrained against axial movement on the cross shaft 62 and this is accomplished by providing a pin 70 in a radially extending bore provided for this purpose in the detector 64, and providing the inner end of the pin 70 with a tapered portion such that this pin can be positioned with its inner end located in the valley defined by the adjacent threads of the detector support shaft 62. As so constructed and arranged, detector 64 is pivotally supported on shaft 62 for movement between the normal and down positions described above. When it is desired to move the detector 64 axially along its shaft 62 the detector 64 is moved to an upright position, as suggested in FIG. 6, such that the inner end of the pin 70 is aligned with a flat segment 62*a* on detector support shaft 62 thereby permitting axial movement of the detector 64 in order to setup the apparatus for accommodating bottles of different diameter. The pin 70 is held in the position shown and described above by clamp screw 72, and the screw may itself be secured in its threaded bore by means of a jam nut 74.

I claim:

1. In a case packer wherein side-by-side lines of articles are fed between lane defining structure across a fixed deadplate into a grid to form a group of articles to be packed upright in a packing case or the like, and wherein the articles are continuously urged downstream across the deadplate into the grid by line pressure requiring a line brake assembly to clamp at least the endmost article in each lane during the packing phase, the improvement to said line brake assembly comprising a fixed frame, with upright portions defining vertically extending guide means, a horizontally extending cross beam slidably received on said guide means, means for clamping said cross beam to said upright portions, a fluid motor with a fixed part secured to said cross beam and a movable part reciprocable with respect thereto, bracket means defining a horizontally extending guideway, which bracket means is mounted for limited vertical movement with reference to said cross beam and which is connected to said movable fluid motor part, a plurality of article engaging brake subassemblies clamped to selected locations on said guideway defining bracket means, and an article height gage block secured to said cross beam to permit locating said cross beam with said gage block in contact with the top of a sample article having a size representative of the articles to be packed the sample article being provided on a reference portion of the deadplate in so locating said cross beam.

2. The combination defined by claim 1 further characterized by article "down" detectors for each lane of articles being fed toward said brake assembly, a cross shaft pivotally supporting said detectors for movement between normal positions wherein a portion of each of said detectors is adapted to engage the top of an upright article in an associated lane and a down position wherein the detector does not engage the top of an upright article, cantilever support means for said cross shaft and carried by said cross beam to be moved therewith.

3. The combination defined by claim 1 further characterized by rack and pinion gear means arranged in part on said cross beam and in part on said fixed frame, and crank means associated with said pinion gear means to raise and to lower said cross beam.

4. The combination defined by claim 2 further characterized by rack and pinion gear means arranged in part on said cross beam and in part on said fixed frame, and crank means associated with said pinion gear means to raise and to lower said cross beam.

5. The combination defined by claim 2 wherein said cross shaft has a flat segment extending axially thereof and wherein the remaining circumference of said cross shaft defines an axially extending thread, said detectors having unthreaded openings for loosely receiving said cross shaft, and a pin received in a bore defined in each of said "down" detectors, said bore oriented radially with respect to said shaft receiving opening, said pin being so located in said detector bore and having an inner end so shaped as to engage the valley between adjacent cross shaft threads to restrict the detector from axial movement on said cross shaft but permitting pivotal movement thereon, each detector thereby being movable pivotally and biased toward the articles therebelow to drop from a normal to a "down" position when no upright article supports the detector in its normal position, said detector being manually movable upwardly beyond said normal position on said cross shaft to align said inner end of said pin with said flat shaft segment and permit axial sliding movement of the detector on said cross shaft for setting said detector at a different axial location on said shaft as required to accommodate articles of different size and to locate said detectors in appropriate lanes of said lane defining structure.

6. The combination defined by claim 3 wherein said rack and pinion gear means comprises two rack segments mounted to said cross beam in vertically oriented parallel positions adjacent said frame side portions, and rollers rotatably mounted adjacent end portions of each rack segment for engagement with said side portions to slidably support said cross beam in conjunction with said vertically extending guide means as aforesaid, and pinions meshing with said rack segments, said pinions and said crank means provided on a shaft which is journalled in said fixed frame.

7. The combination defined in claim 6 wherein said fixed frame further includes projecting portions secured to said upright portions, bearing blocks mounted to said projecting portions for rotatably receiving said shaft for said pinions and crank means, and a threaded shaft having end portions secured in said projecting frame portions, said threaded shaft being adapted to loosely receive lane defining spacers thereon, and hand nuts threadably received on said threaded shaft for clamping said spacers and thereby the lane defining structure itself to the machine frame, said spacers having a U-shape to permit them to be removed, without disassembling the lane defining structure.

8. The combination defined by claim 5 wherein each detector comprises a U-shaped element with the base of the U-shape defining said opening for loosely receiving said cross shaft and the legs of the U-shape oriented generally parallel to said radial pin in said threaded bore, one leg of each U-shape being longer than the other for engaging the articles therebelow and the shorter leg being so oriented with respect to said longer leg as to define a light opening therebetween, and a photocell and light beam provided in said bracket means so as to pass a beam of light through said light openings of all of said detectors when upright articles are below said "down" detectors to hold said detectors in their normal positions.

9. The combination defined by claim 8 further characterized by means for releasably clamping each of said pins in said radial bores at said locations for achieving said pivotal movement of said detectors, each said pin clamping means comprising a screw oriented at right angles to said radially oriented pin, and said screw threadably received in a threaded bore defined for it in said detector.

10. The combination defined by claim 3 wherein each of said article engaging brake subassemblies comprises a head portion including means for clamping said head portions to said guideway defining bracket means, each said brake subassembly also including an article engaging part movably mounted in said head portion, and biasing means to urge said article engaging part downwardly toward a lower limit position such that engagement with an article to be braked, as achieved by said fluid motor, will cause upward movement of said article engaging part relative to it's associated head part.

* * * * *